US007506470B2

(12) United States Patent
Pereksta

(10) Patent No.: US 7,506,470 B2
(45) Date of Patent: Mar. 24, 2009

(54) GUN SUPPORT FOR HUNTERS

(76) Inventor: Michael E. Pereksta, 14 Fremont Ter., Oak Ridge, NJ (US) 07438

( * ) Notice: Subject to any disclaimer, the term of this patent is extended or adjusted under 35 U.S.C. 154(b) by 0 days.

(21) Appl. No.: 11/546,900

(22) Filed: Oct. 12, 2006

(65) Prior Publication Data

US 2008/0086928 A1 Apr. 17, 2008

(51) Int. Cl.
*F41C 27/00* (2006.01)

(52) U.S. Cl. ..... 42/94; 224/149; 2/94

(58) Field of Classification Search ..... 42/94; 224/149; 2/94

See application file for complete search history.

(56) References Cited

U.S. PATENT DOCUMENTS

| | | | | | |
|---|---|---|---|---|---|
| 1,112,732 | A | | 10/1914 | Uhl | 42/94 |
| 1,519,123 | A | * | 12/1924 | Edwards | 2/94 |
| 2,948,449 | A | | 8/1960 | Aronson et al. | 224/149 |
| 3,313,505 | A | | 4/1967 | Petrie | 248/165 |
| 3,430,828 | A | | 3/1969 | Gregson | 224/149 |
| 3,606,109 | A | | 9/1971 | Brokus | 224/149 |
| 3,665,632 | A | | 5/1972 | Ford | 42/71.01 |
| 4,243,165 | A | | 1/1981 | Schuler | 224/149 |
| 4,345,398 | A | | 8/1982 | Pickett | 42/94 |
| 4,393,614 | A | | 7/1983 | Pickett | 42/94 |
| 4,691,852 | A | | 9/1987 | Phelps | 224/150 |
| 4,967,497 | A | | 11/1990 | Yakscoe | 42/94 |
| 5,092,505 | A | | 3/1992 | Olschlager | 224/150 |
| 5,325,618 | A | | 7/1994 | Turner | 42/85 |
| 5,345,706 | A | | 9/1994 | Brown | 42/94 |
| 5,575,411 | A | | 11/1996 | Hightower | 224/149 |
| 5,669,170 | A | | 9/1997 | Norris | 42/85 |
| 5,680,939 | A | | 10/1997 | Oliver | 211/64 |
| 5,685,103 | A | | 11/1997 | Wiggins | 42/94 |
| 5,913,668 | A | | 6/1999 | Messer | 42/94 |
| 5,930,931 | A | | 8/1999 | Watson | 42/94 |
| 6,260,748 | B1 | | 7/2001 | Lindsey | 224/150 |
| 6,267,335 | B1 | * | 7/2001 | Barrett | 248/118 |

(Continued)

*Primary Examiner*—Michael J. Carone
*Assistant Examiner*—Gabriel J Klein
(74) *Attorney, Agent, or Firm*—Ernest D. Buff & Associates, LLC; Ernest D. Buff; Dave Narasimhan

(57) ABSTRACT

A hands-free gun support has an adjustable telescoping barrel stand that supports the front end of a gun in a cradle. The gun butt is attached to a gun butt harness, which is removably attached to a shoulder harness worn by the hunter. The gun is aimed at the firing position and both the telescoping barrel stand and the butt harness support are adjusted so that the gun is completely supported in the firing position and the user's hands are free. The barrel stand height, as well as the horizontal and vertical orientation of the gun mounting cradle can be adjusted and locked. Adjustment of the gun butt harness is accomplished by a standard adjustable clip and a push-button clip in the shoulder harness. The gun support is especially suited for hunting turkey hunting or other game animals that are extremely sensitive to the slightest movement of the gun or the person holding the gun. Hunters engaged in such pursuits must spend long hours holding the gun steady without motion. This otherwise painful task is ameliorated by the hands-free gun support. In use of the present invention, the hunter's hands are not required to hold, steady or aim the gun. All the hunter needs to do is to wait without movement until the time for a firing event.

11 Claims, 7 Drawing Sheets

U.S. PATENT DOCUMENTS 6,305,117 B1 10/2001 Hales, Sr. ..... 42/94
6,325,258 B1 12/2001 Verdugo et al. ..... 224/150
6,920,713 B1 * 7/2005 Love ..... 42/94
6,935,065 B1 8/2005 Oliver ..... 42/94

* cited by examiner

GUN SUPPORT FOR HUNTERS

BACKGROUND OF THE INVENTION

1. Field of the Invention

The present invention relates to gun supports for hunters; and, more particularly, to a hands-free gun support adapted to provide a steady rest that maintains the gun in an appropriate firing position.

2. Description of the Prior Art

Numerous patents disclose supports for either the front or the back of a gun. These supports require that the hunter steady the gun by continuously holding it in a supported portion. Moreover, with such patent teachings, the support provided is either bulky, or complex in construction, and is not easily adjusted to bring the gun into a properly aimed, firing position.

U.S. Pat. No. 1,112,732 to Uhl discloses a firearm support. The support provides means for supporting a firearm, to provide a steady gun rest for aiming a gun. An extensible member has a socket that connects to the member through a swivel joint. The gun barrel is engaged by an adjustable yoke or socket connected to the swivel. This gun support only provides support to the gun barrel at the very tip. The handle portion 'a' of the gun is not supported, so the user must provide the requisite support. Also, the presence of the swivel 'c' allows rotation of the gun barrel, which impairs the user's ability to steady the handle of the gun.

U.S. Pat. No. 2,948,449 to Aronson et al. discloses a gun holder. This gun holder is a support for a shotgun or rifle. A cup is provided which receives the butt end of a gun and is held on a strap across the chest of the user. This support holds the butt end of the gun by a shoulder strap. The barrel of the gun is not supported and has to be manually held at all times. The gun holder disclosed by the '449 patent does not provide gun support in the shooting position. It is merely used to facilitate transportation of a heavy gun.

U.S. Pat. No. 3,313,505 to Petrie discloses a collapsible stand. This adjustable collapsible stand may be used by a plumber to support pipes. The adjustable collapsible stand is for supporting pipes, aiding a plumber's operations. No disclosure is contained therein that concerns supporting a gun. The pipe is only supported in the downward vertical direction. It is not supported in the upward vertical direction, and can be lifted or rocked easily. This movement is unacceptable for a gun support, since the gun barrel needs to be aligned with the target.

U.S. Pat. No. 3,430,828 to Gregson discloses a gun sling. The sling facilitates carrying a gun and is usable by right handed or left handed persons. This gun sling attaches the butt of a gun to a sling strap member and enables easy transportation of the gun. Since the barrel of the gun is unsupported, it has to be carried by the user at all times. The gun sling does not support the gun in the firing position. Any movement of the gun will be detected by the wild game target such as a turkey.

U.S. Pat. No. 3,606,109 to Brokus discloses a gun sling. This gun sling is placed on the shoulder of the user and is attached to a stock receiver through a swivel connection. The stock receiver is pivoted on the gun stock at its attachment point. When the gun is lifted by the user, the stock receiver swings away from the gun stock. This allows free placement of the gun against the user's shoulder, and enables the weight of the gun to be no longer carried by the strap. Therefore, the gun is clearly unsupported in the shooting position and is only supported when it is not in use and hung from the shoulder.

This device is unsuited for turkey hunting, since the user must freeze motion in the shooting position, at which point the gun sling provides no support.

U.S. Pat. No. 3,665,632 to Ford discloses a firearm shoulder support and strap attachment. This device supports the gun on the shoulder. A mounting plate is screwed to the butt end of the gun and carries a shock absorbent recoil pad, a rigid support member and a strap. The gun is attached to the shoulder and when used, the recoil pad absorbs the shock. Since the gun is only supported on the butt, the user has to hold the gun steady in the firing position for prolonged time periods. This requirement can be exhausting when hunting wild game, such as turkey.

U.S. Pat. Nos. 4,243,165 to Schuler discloses a shotgun butt cap. An adjustable strap attaches the shotgun butt cup to the shoulder. The butt cup with foam pad allows precise placement of the shotgun in a fixed position, which is selected by the user, providing improved and repeatable shooting precision. During use of the gun, the butt cup that is attached to the shoulder strap supports the butt of the gun. The user has to support the barrel of the gun. In the case of turkey hunting, the user must "freeze" for long periods of time in the shooting position, which tends to be tiresome.

U.S. Pat. Nos. 4,345,398 and 4,393,614 to Pickett disclose a gun rest. This gun rest is a monopod with extensible segments to adjust the height of the monopod. A clamp mount plate carried by the monopod has two U shaped clamps that attach to the barrel of a gun. The clamp mount plate is mounted to the monopod by a pivoting attachment so that the clamp mounting plate may be attached to the monopod when the gun rest is not in use. This gun rest in the 'in use' position supports the gun barrel. The back end of the gun is not supported and this support needs to be provided by the user. Holding the back portion of the gun for an extended period of time may result in the movement of the gun front tip, causing wild game targets such as turkey to fly away.

U.S. Pat. No. 4,691,852 to Phelps discloses a gun sling. One end of the sling is attached to the butt of the gun while the other end of the gun is attached to the barrel or muzzle of the gun, so that the gun essentially hangs from the shoulder. The gun may be fired in this supported 'patrol' position without being aimed at any specific target. The aiming of the gun to a specific target requires the gun to be lifted and rested on the shoulder in the usual manner. At this position, the gun is essentially unsupported. Therefore, this gun sling does not provide support in an aimed firing position.

U.S. Pat. No. 4,967,497 to Yakscoe discloses an adjustable and collapsible gun and rifle support. An extendable vertical shaft is connected to a horizontal shaft through a connecting shaft that adjusts the degree of collapse of the vertical shaft. A cradle is connected to the end of the vertical shaft extension. The gun is placed on the cradle, which is provided with upright extending supports. The gun is entirely supported by the cradle and is only rotatable in its plane by the pivotable support. As a result, the angle of the gun cannot be readily adjusted. The user must unscrew the connecting shaft to change the orientation of the vertical shaft. This operation changes the plane of the gun, as adjustable by the pivotable support. The user is therefore unable to accurately aim the gun at a target. Fast and easy aiming of the gun is thereby compromised by the gun support's rigidity.

U.S. Pat. No. 5,092,505 to Olschlager discloses a shotgun sling apparatus. This sling comprises a strap attached on one side to a flexible support tube on the gun barrel and on the other side to a pocket that receives the butt of the gun. The sling is readily attached to a gun. It may be removed at will and provides a support mechanism during transportation of the gun. The sling does not support the gun during shooting at a target.

U.S. Pat. No. 5,325,618 to Turner discloses a safety device for a rifle. A chest harness carried by the safety device is additionally supported at the shoulder. The butt of a fire arm is captured in the vertical position, leaving the hands of the user free and the muzzle of the gun pointed safely away from the user. A cord connected to the butt supports the butt of the gun when it is removed from the vertical position chest support. Neither the chest support nor the cord supports the gun in the firing position.

U.S. Pat. No. 5,345,706 to Brown discloses a firearm support. An adjustable monopod device connects to a sling post of a rifle through a pivoting or folding cradle assembly. The rifle may be tilted or turned when supported by this firearm support. In order to operate, the firearm support must be balanced exactly at the center of gravity of the gun. Any slight movement of the gun by wind or the like will disturb this arrangement causing the support to fail. Consequently, aiming of the gun at a target is very difficult. Firing the gun can disturb the support arrangement, since the butt of the gun is not supported in any manner.

U.S. Pat. No. 5,575,411 to Hightower discloses a butt stock sling attaching device for a shotgun. The butt stock sling attaching device secures a sling to a shotgun, rifle or the like. A primary loop of the attaching device has a stock toe engaging bight. A "D"-shaped ring carried opposite thereto is attached to a sling. A pair of secondary loop portions are attached at one end to side portions of the primary loop. The secondary loop portions are brought into overlying relationship to a stock comb having hook and loop fastenings that maintain the secondary loop portions in secure, though removable, fastening relationship to each other. The primary loop includes a half-twist for achieving proper orientation of the "D"-shaped ring relative to an associated sling. This sling attaches to the fore stock of the gun on one side and to the butt stock on the other side. The '411 patent discloses the attachment of the sling at the butt stock and teaches a primary and a secondary loop. The '411 patent does not disclose a support that secures the position of the gun hands-free in a firing position.

U.S. Pat. No. 5,669,170 to Norris discloses a hands-free sling for carrying a long gun or other elongated article. This sling for a long gun and other articles has a belt that fits about the waist and a shoulder strap that passes over the shoulder and fastens to the belt at both ends. The shoulder strap includes two chest mounting members that hold a long gun adjacent the chest so that the user can carry the gun without using his hands. The belt, shoulder strap and mounting members are adjustable. The sling optionally includes a chest strap that fits around the chest and is coupled to the shoulder strap in the front and back. This hands free sling comprises one or two straps around the chest of the user that is also supported on the shoulder. The rifle or long object is attached to the chest straps and supports the long object in a vertical position, providing hands-free carrying of the rifle. However, in use of the rifle, the attachment of the rifle to the chest belt is released. Therefore this sling arrangement does not support the gun during firing, at which point, the arrangement is no longer hands-free.

U.S. Pat. No. 5,680,939 to Oliver discloses a ground engagable gun support. This ground engagable gun support apparatus comprises a main elongated tube and an adjustable elongated tube slidably attached to the main elongated tube by a pair of stabilizing bars. Securing means are provided that are adjustable vertically and are rotatable about the main elongated tube. The butt of the gun is supported by a butt support tray at the lower end of the elongated tube. The barrel of the gun is supported by a "Y" shaped barrel support bracket attached at the upper end of the adjustable elongated tube. A strap is affixed to the main elongated tube for carrying and camouflage coloring for non-detectibility by game, when employed by the user in the field, or safety coloring for visibility in the field. This gun support supports a rifle, particularly with a scope, in the vertical position. It dies not support a rifle in the 'in use' gun firing position.

U.S. Pat. No. 5,685,103 to Wiggins discloses a gun support. This device is operative to support a gun from a tree. The gun has a scope and the device supports the gun from the scope. A plate is adapted to be attached to a tree by the use of an adjustable strap that surrounds the tree. An arm pivotally attached to the plate extends therefrom so that an elastic member may be attached to the end of the arm distal from the plate. A harness having a body and a first and second belt connected to the elastic member is provided. The first and second belt encircle the front end and back end of the scope, respectively, and support the gun. The first and second belts are adjustable so that the gun can be balanced within the harness. This gun support is a plate that is attached to a tree carrying a swingable arm to which an elastic member is attached that carries the gun and the scope. The hanging position of the gun is dependent on the location of the gun's center of gravity and may be horizontal or inclined. The user has to rotate and aim the gun-providing support. Due to the elasticity of the elastic member, which counteracts the support provided by the user, it is very difficult to aim and hold the gun steady.

U.S. Pat. No. 5,913,668 to Messer discloses a weapon rest. This weapon rest, which is characterized by its simplicity and stability, comprises a base, a shaft, a cradle movably attached to the shaft and a tensioning means situated between the cradle and the shaft. This tensioning means imparts stability to the cradled weapon, permitting the use of scopes of extraordinary powers of magnification. This weapon mount uses a tripod to attach a gun carrying cradle. The cradle can be displaced but not turned. Therefore, the user must lift the complete tripod mounted gun and direct the gun's aim towards a target. This process of aiming a target is extremely cumbersome and imprecise, especially when a high power magnification scope is to be used to aim a target. Such an aiming process involves a large amount of movement, which will disturb game.

U.S. Pat. No. 5,930,931 to Watson discloses adjustable gun rest. This portable gun rest comprises a thigh support member adapted to fit over a user's thigh. A telescoping support assembly is pivotally connected to the thigh support member. The telescoping support assembly includes a gun support member connected to the telescoping support assembly, and the gun support member is rotatable about the longitudinal axis of the support member. This gun rest is attached to the user's thigh. It must be secured by straps, and carries the gun. Once the gun rest is secured in this manner and is aimed at a potential target, the user must sit in this awkward posture for a long time. The only adjustment possible involves rotation of the gun in the horizontal plane. Adjustment of height requires the loosening of the setscrew and elongating the central shaft, which is time consuming. There is no provision for inclining the gun. The attachment to the thigh does not provide a steady rest since the thigh can move and the user may loose balance.

U.S. Pat. No. 6,260,748 to Lindsey discloses a weapon sling and attachments. This weapon sling includes a cross body loop with a length adjustment and lower sling attachment for the rear end of a weapon. The length of the loop can be adjusted to conform to individual body sizes. The upper end of the loop has a clasp and an extension strap affixed thereto. The opposite end of the strap has a mating clasp for the clasp on the loop and an upper attachment for attaching to the front end of a weapon. This sling is an adjustable shoulder strap with attachment to the butt of the gun and a second strap attached to the front of the gun. When the attachment to the second strap is released, the gun is in the firing position. Since the second strap is loose, the user must aim and hold the gun during firing. The front end of the gun is not supported in the firing position. It is not clear how the butt end of the gun is brought to the common shoulder level since it is attached at the lower end of the sling. If the lower attachment has to be removed, the gun is entirely unsupported in the firing position.

U.S. Pat. No. 6,305,117 to Hales, Sr. discloses a support for rifle sighting. A configurable device for supports, sights and fires both shouldered and hand-held firearms. The device includes a tripod base having front and rear extensible vertical supports. The extensible supports are provided with substantially U-shaped cradle elements for holding a firearm. The extensible supports are pivotally mounted in brackets attached to the base permitting folding thereof. The extensible supports allow a wide range of vertical adjustment for sighting and firing from various positions, such as sitting, kneeling and standing positions. The rear support is slidably mounted to the base, thereby providing an adjustment mechanism for accommodating various lengths of shouldered firearms as well as hand-held firearms. The device can be folded for convenient storage and transport and is used just as easily in the field or on a shooting bench. A separate front cradle support and a rear cradle support are used to support the front and back of a gun, respectively. These supports are connected to a base over which the rear support can slide. The attachment of the front and back support to the base is pivoted in that it can be moved within the vertical plane. The height of the front and back support is individually adjustable. The gun cannot be rotated in the plane of the gun to aim at a target. Adjusting the angle of inclination of the gun requires the adjustment of front or back pivot and adjustment of the height of front or back support. Such an adjustment process involves an elaborate procedure, and the movement required during the adjustment process will disturb game.

U.S. Pat. No. 6,325,258 to Verdugo et al. discloses a tactical sling system. This adjustable sling system provides a quick release fitting which enables a sling system to transition from a close-to-the-body quick fire position to an away-from the body aiming position. The gun is carried on a shoulder supported sling that attaches on one end to the rear of the gun while the front end attaches to a buckle that slides on a web strap, thus changing the gun from the carrying position to a firing position. The gun butt is not supported by the shoulder sling when aimed at a target. Rather, bullets are sprayed using a machine gun in a general direction. This is not a support for a hunting gun such as a rifle.

U.S. Pat. No. 6,920,713 to Love discloses a gun support for hunters. This gun support for hunters has interchangeable features. The gun support includes a support rod having a proximal end and a distal end. A cradle is removably attached to the proximal end of the support rod. The cradle includes a base, a first fork pending from a first side of the base, and a second fork pending from a second side of the base. A retaining device is disposed on the first and second forks. A biasing strap is removably attached to the retaining device on at least one of the first fork and second fork. The biasing strap is configured for retaining a gun barrel between the strap and the base of the cradle for steadying the gun of a hunter. In this gun support arrangement, the gun barrel is supported on a fork supported on a pole. The pole is in turn supported on a quadrapod or other stand. There is no support for the butt portion of the gun. In one embodiment of the '713 disclosure a ball joint is provided for adjusting the inclination of the gun barrel and at these inclinations the barrel could slip away in the fork. This makes the game target aiming process difficult.

U.S. Pat. No. 6,935,065 to Oliver discloses a gun support. The gun holder and support apparatus combines multiple gun engagement functions in a compact adjustable transportable configuration. The gun support device provides for a self-supporting and portable field gun holder with adjustment brackets to accommodate different rifle gun types. It also acts as a gun barrel rest during firing. This gun support is mainly used for storing the gun in a vertical position. The gun may be removed from the support and used in the firing position while being supported by both hands. The barrel of the gun may be supported on the Y shaped rest at the upper end of the gun support. The butt portion of the gun must still be manually supported.

U.S. Patent application publication No. 20020036219 A1 to Neighbors discloses a hands-free gun holder. This hands-free gun holding device comprises a flexible sling, an attachment mechanism, and an anti-slip liner. The sling of the device is adjustably attached to a hunting jacket by the attachment mechanism and supports the butt of the gun, thereby leaving a hunter's hands free to use animal calls and binoculars, and to perform other functions useful in hunting. The liner covers at least a portion of the inside of the sling thereby preventing the gun butt from slipping out of the sling. The flexible sling lies flat against the hunter's jacket when not being used. Therefore, the sling does not interfere with other hunting activities. This gun-holding device allows the hunter to minimize both gun and body movements, as well as resulting unwanted noise. It therefore reduces the chance that the animal will detect the hunter. This gun holder is a pocket receiving the butt of a gun and is attached to the jacket or vest of a hunter by buttons. The front barrel of the gun must be supported in the firing position. Hunting turkey requires the user to freeze in this firing position, fully supporting the front of the gun—an operation which is tiresome.

Notwithstanding the efforts of prior art workers to construct a gun support system for hunters, there is a strong need for a hands-free gun support that freezes and supports a gun in the firing position. Also needed is a hands-free gun support that relieves the user from the tiresome task of holding the gun motion free for prolonged periods of time. Further needed is a gun-support that can be operated without alerting target games to the presence of the gun or the hunter. Using the hands free gun support of the subject invention, the hands of the user are not tired from holding the gun motion-free. Advantageously, the user needs only to pull the trigger at the appropriate time.

SUMMARY OF THE INVENTION

The present invention provides a hands free gun support apparatus for hunters. In particular, the apparatus comprises a telescoping barrel stand having a top and bottom portion, a shoulder harness worn by the user that can be attached to a gun butt end harness whereby the telescoping barrel stand provides support to the front end of the gun and the shoulder harness attached to the butt end harness supports the butt end of the gun in the firing position selected by the user. The telescoping barrel stand can be collapsed and made parallel to the gun barrel by using a pivot connection at the barrel stand attachment region. The folded collapsed telescoping barrel stand is secured to the gun butt by a strap. In this position, the gun with the collapsed barrel stand may be transported easily and the gun is set up at any desired location for aiming at a target. In addition, the smooth surface of the collapsed barrel may be rested on a solid stationary object such as a rock or a windowsill providing an alternate front support of the gun. In this aimed position, the butt end of the gun is supported by the gun butt harness that is attached to the shoulder harness providing hands free gun support. In the case of instantaneous aiming requirements, the gun butt may be held by hand while most of the weight of the gun is supported by the front telescoping barrel stand support that rests on a solid object.

Generally, the gun barrel is rested on a cradle attached to an adjustable telescoping barrel stand that holds the gun near its center of gravity. With this arrangement, there is provided a front gun support while a gun butt harness attached to a shoulder harness worn by the user provides backs support to the gun. The telescoping barrel stand comprises two tubes adapted to slide into each other and fixed at a desired height by a setscrew. This sliding motion between the tubes also allows the free rotation of the upper tube of the barrel stand with respect to the lower tube of the barrel stand. The bottom portion of the adjustable barrel stand is provided with a plurality of foldable legs. In a preferred arrangement, the configuration of a plurality of legs forms a triangular configuration so that the barrel stand rests on the ground. The upper portion of the barrel stand has a hinge that is locked by a lynch pin which locks the upper tube in a vertical configuration or horizontal configuration. The distal end of the hinge is attached to a cradle that supports the barrel of the gun. While the barrel of the gun may be freely slid and locked in position within this cradle, it is preferable to lock the barrel near the center of gravity of the gun so that the gun is fully supported without hand use. The hinge may be provided with a friction device allowing locking of the hinge at any arbitrary angle. The height of the gun is adjusted by the sliding movement of the upper and lower tubes of the barrel stand. The inclination of the gun in the horizontal plane is adjusted by the rotational movement between the upper and lower tubes of the barrel stand. The user can therefore aim and adjust the vertical and horizontal angles of the gun and securely lock its position.

In selected target aiming directions and gun barrel fixing positions within the cradle, the gun may still need some additional support at the butt end and this is provided by a second support attachment to the gun. The butt of the gun is attached to a removable sleeve or harness that has a buckle. This gun harness buckle mates with a shoulder harness buckle worn by the user.

In the first embodiment, the user initially adjusts the gun for a specific firing configuration, setting the height of the barrel support, the angle in the horizontal plane (using the sliding action between the two tubes of the barrel stand) and the angle in the vertical plane (using the lockable hinge) according to the game target aiming requirements. The user then adjusts the shoulder harness and buckles the shoulder harness to the gun butt harness buckle so as to lock and maintain precise firing aim. Changes to the gun butt support are accomplished by adjusting the shoulder harness. Now the hands of the user are free to use decoys, calls and other hunting devices. All that is required of the user is to wait motion free and pull the trigger at the chosen time. Since the user's hands are free from the task of carrying the gun they are not fatigued. The gun is precisely set in the firing position and is completely supported.

In the second embodiment, the barrel stand and legs are first folded. The barrel stand is then collapsed by sliding the two tubes. The barrel stand is folded at the hinge between the barrel stand and the cradle and brought to a horizontal position and locked by the lynch pin. In this position, the barrel stand is nearly parallel to the gun barrel. The lower tube of the barrel stand has a strap at its distal end and is used to encircle the butt of the gun, locking the barrel stand against the butt of the gun. The strap is secured by suitable attachment means such as Velcro. The smooth surface of the barrel stand, which is parallel to the gun barrel but displaced from it provides a sliding rest surface. Thus, the gun may be rested on a steady rest such as a rock, windowsill or the like using the smooth surface of the barrel stand when the gun is aimed at a game target. In this aimed position, the butt end of the gun with the gun butt harness is attached to the shoulder harness using the buckle. This requires adjustment of the shoulder harness and the aiming position is maintained leaving the hands of the user free. In an emergency situation, the butt end of the gun may be aimed using one hand. This action is not tiresome, since the front end of the gun is supported by the smooth barrel stand surface that rests on a steady object.

BRIEF DESCRIPTION OF THE DRAWING

The invention will be more fully understood and further advantages will become apparent when reference is had to the following detailed description of the preferred embodiments of the invention and the accompanying drawings, in which.

DETAILED DESCRIPTION OF THE INVENTION

Figure 1:
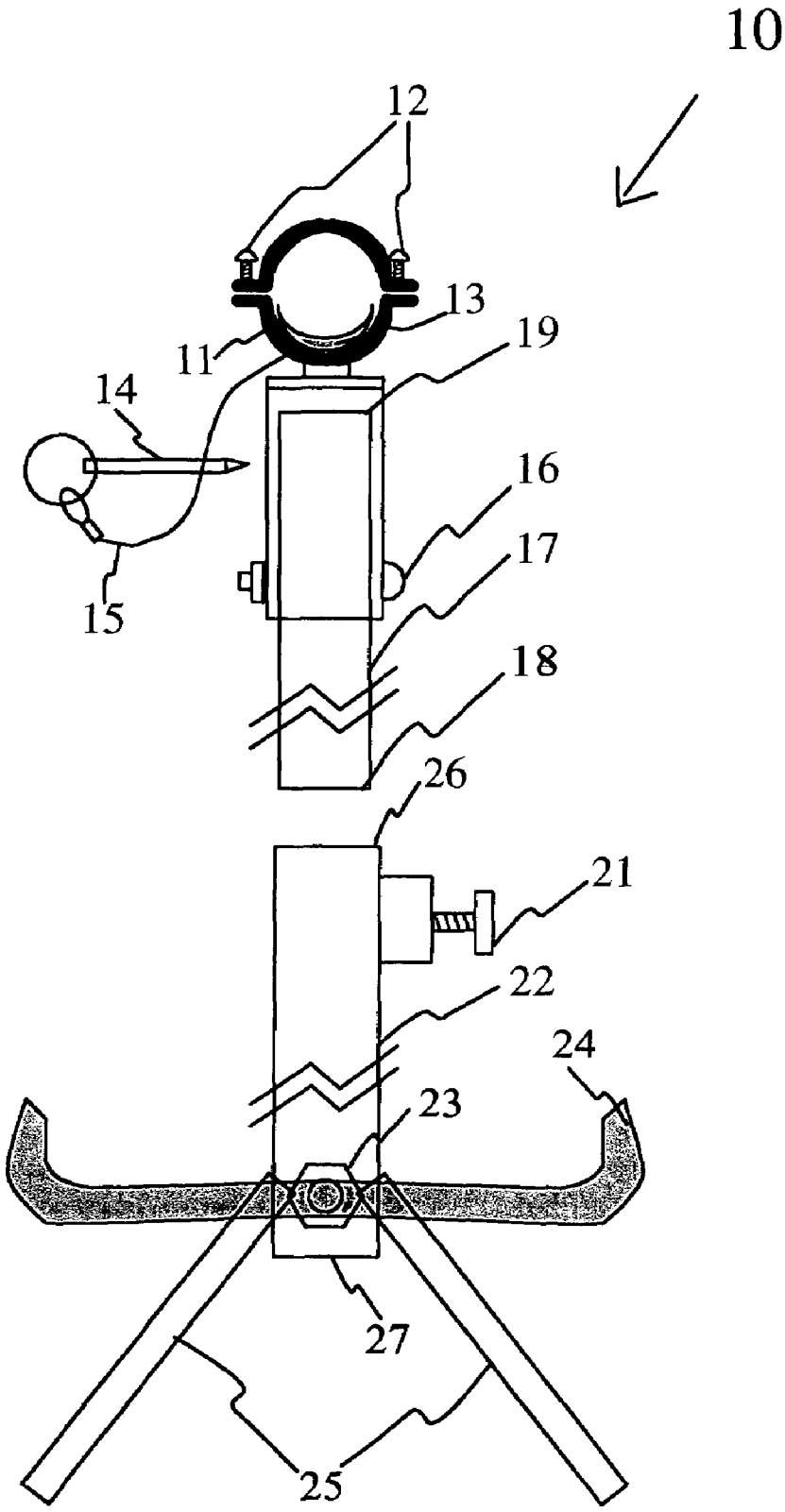
FIG. 1 is a schematic diagram of the telescoping barrel stand.

The present invention provides a gun support for hunters. The gun support is especially suited for use while hunting turkey or other wild game. The gun support allows hunters to keep their hands free, while their gun is supported in a suitable position for aiming and firing at the target.

Turkey hunting is a popular sport that demands tremendous patience and skill. The turkey hunter typically dresses in camouflage and sits on the ground with his back against a tree trunk. He lures the turkey by using sounds familiar to a turkey. In order to make these sounds, it is highly desirable for the hunter to have full use of his hands. One technique for luring a turkey involves scratching against a plate and/or in the grass with both hands. Turkey hunters typically rest the gun on their lap or knee while using their hands to make these luring sounds. Moreover, even when not making luring sounds with their hands, turkey hunters tend to rest the gun on their lap or knee in order to rest their arm and shoulder muscles. Such resting position is frequently required, owing to the fatigue otherwise occasioned by holding a gun in the air for extended periods of time. If the gun is resting on the hunter's lap or knee when a turkey appears, the hunter must then pick up the gun and raise it to eye level to aim and fire at the bird. Turkeys have extremely keen eyesight and are able to pick up even the smallest movements. Accordingly, there is a strong prospect that a turkey will flee and thereby escape capture if the hunter makes obvious movements of his gun.

By supporting the hunter's gun in a suitable position for aiming and firing, the gun support of the present invention provides several advantages to its user. The hunter is able to use his hands to make calling sounds and the like while the gun is completely supported in a proper shooting position. The hunter is well rested and able to aim the gun with more precision when the time comes, improving prospects for an ethical shot.

Generally stated, the Gun Support comprises three (3) main portions: (i) a barrel stand, including a top tubular portion and a bottom tubular portion, (ii) a shoulder harness, and (iii) a gun harness.

The barrel stand has an upper tube and a lower tube with a cradle attached to the upper tube. The gun barrel is attached to the cradle using an upper holding member with two screws. A lockable hinge is provided between the cradle and the upper tube and optionally may have frictional elements to provide resistance to uncontrolled rotation of the cradle with respect to the upper tube of the barrel stand. This lockable hinge provides the ability to incline the cradle with respect to a horizontal plane. The upper and lower tubes slide within each other to adjust the height of the cradle and its horizontal orientation. A setscrew locks the relative position of the upper tube with respect to the lower tube fixing the height and horizontal orientation of the cradle. The lower tube has three foldable legs at its distal end that supports the barrel stand on level or sloping terrain. A Velcro strap is attached to the bottom of the lower tube of the barrel stand for attaching the gun butt to the folded collapsed barrel stand.

The shoulder harness is adjustable and is worn across the chest of the user either on the right or left shoulder similar to a sash. The shoulder harness has a first portion of a nylon-webbing strip with a push-button type clip on one end for attachment to the belt of a user on the user's backside. The length of this nylon-webbing strip is adjustable by a standard adjustable clip. The distal end of the nylon-webbing strip opposite to the push-button clip is attached to a bungee cord, which carries a second push-button clip for attachment with the front side belt of the user. The length of the bungee cord is also adjustable by a standard adjustable clip. Thus the shoulder harness is tightly held diagonally against the chest of the user by using the adjustable clip in the nylon-webbing strip and the bungee cord. The nylon-webbing strip close to the bungee attachment point carries a second nylon-webbing belt. This belt is held in place by two grommet hole snaps, and carries a buckle female snap clip designed to receive a buckle male snap clip attached to the gun butt harness. The location of the buckle female snap clip can be adjusted by the standard adjustable clips provided on the nylon-webbing strip and the bungee cord. Thus, the location of the buckle female snap clip in the shoulder harness and the overall length is adjustable.

The gun harness covers the stock portion of the gun and is held securely in place. The stock of the gun is inserted into the gun harness through the opening shown at 48. The back of the gunstock rests against nylon webbing at 43. The bottom of the gunstock rests against nylon webbing at 47. The top and sides of the gunstock rests against nylon webbing at 44, 45, and 46, respectively. A piece of nylon strap 42 connects the gunstock to a male snap clip 41. The male snap clip 41 is operable for connection with the female snap clip 31 on the shoulder harness and with this attachment the gun is now fully supported.

FIG. 1 illustrates generally at 10 the telescoping barrel stand. The barrel stand includes a top tubular portion 17 and a bottom tubular portion 22. The top portion has a first end 19 and a second end 18. Similarly, the bottom portion has a first end 26 and a second end 27. The second end 18 of the top portion is inserted into the first end 26 of the bottom portion, creating a telescoping cylindrical support rod 17, 22. Bottom tubular portion 22 has three foldable legs 25 at its distal or second end 27 that support the barrel stand on level or sloping terrain. Foldable legs 25 are pivotally connected to second end 27 via screw 23 so that foldable legs 25 can rotate to the standing configuration (as shown) or to a folded configuration during transport. Foldable legs 25 can be positioned horizontal, as shown at 24, for level terrain. The height of the barrel stand and its horizontal angle is adjusted by loosening a setscrew 21 present in the bottom tubular portion. The height of telescoping barrel stand support rod and the orientation of the upper tubular portion is adjusted by loosening this setscrew and adjusting both parameters, and re-tightening the setscrew 21. A gun barrel cradle 11 is located at the first end 19 of the top portion 17 of the barrel stand. Gun cradle 11 includes a surface 13. The gun barrel is removably received by this cradle and is tightened by use of two setscrews 12. Below the cradle, and near the first end of the top tubular portion a hinge 16 is provided. Using this hinge, the cradle may be positioned and locked at suitable angular location by lynch pin 14 or other suitable friction locking mechanisms (not shown) at various vertical plane angles pointing the gun attached to the cradle in various inclinations. Lynch pin 14 is connected via cord 15 to top tubular portion 17. Therefore, the height of the gun, its angular orientation in the horizontal as adjusted by the two tubes of the barrel stand and its vertical orientation, as adjusted by the hinge securement is completely controlled by the user in the game target aiming process.

Figure 2:
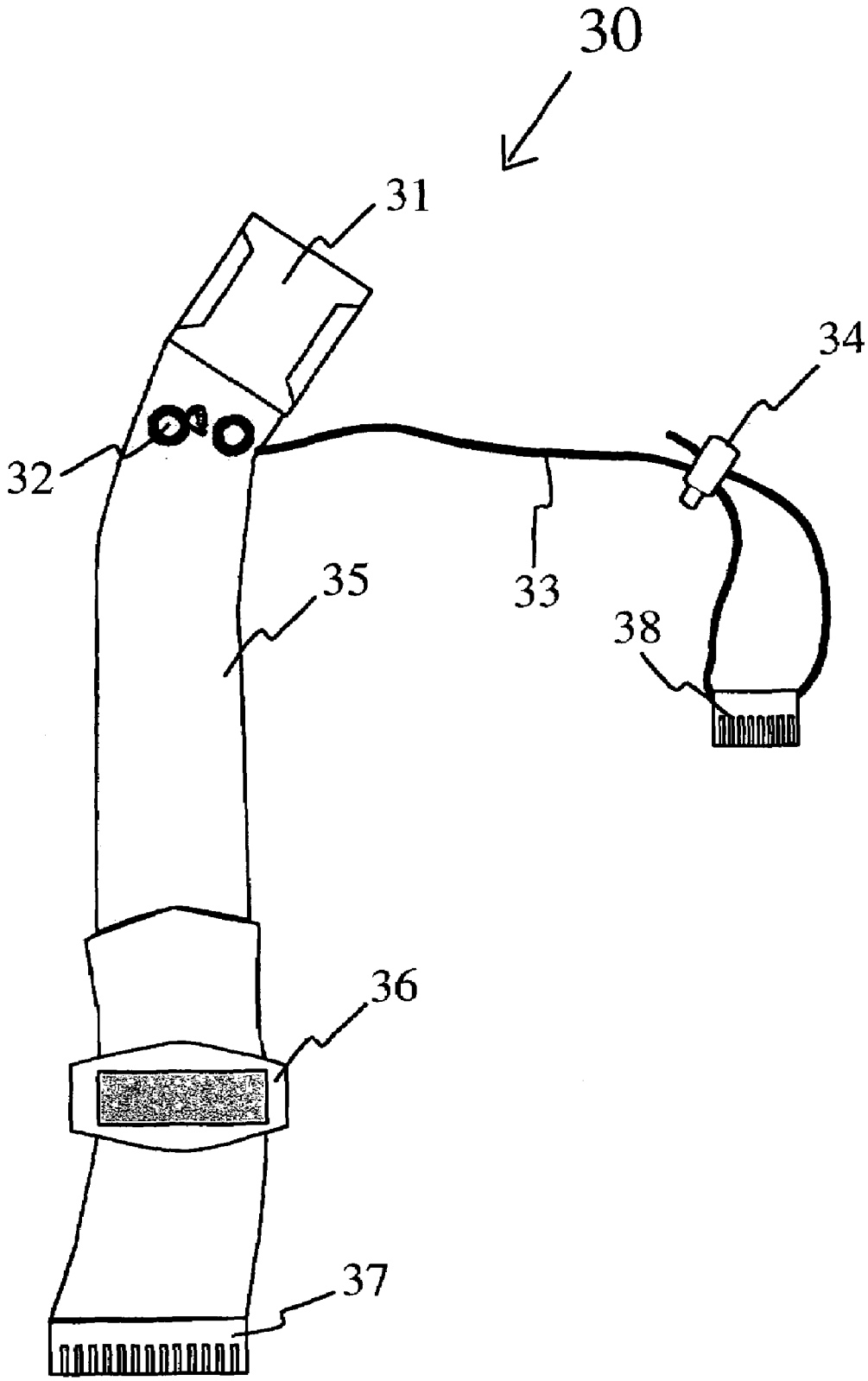
FIG. 2 is a schematic diagram of the shoulder harness.

The gun supported on the cradle mounted on the barrel stand is generally insufficient to hold the gun in an aimed position for prolonged periods. Additional support is needed at the butt end of the gun. This is provided by the combination of shoulder support and gun harness. The shoulder harness is shown generally in FIG. 2 at 30. The shoulder harness is worn diagonally across the chest of the hunter, similar to a sash. The shoulder harness has a first portion and a second portion. The first portion consists of nylon-webbing strap 35. The second portion consists of a bungee cord 33 that is attached to the nylon-webbing strap 35. The first portion of the shoulder harness is attached to the backside belt of the hunter with clip 37. The bungee cord 33 of the second portion of the shoulder harness is attached to the front side belt of the hunter with push-button clip 38. The shoulder harness is tightened about the chest of the hunter by using a standard adjustable clip 36 and a push-button type adjustable clip 34. A female snap clip 31 is attached to the shoulder harness near the place where the bungee cord is attached and is held in position by two grommet hole snaps 32, 32. The shoulder harness is typically adjusted with the standard adjustable clip 36 so that the female snap clip 31 is positioned near the top of the chest of the hunter.

Figure 3:
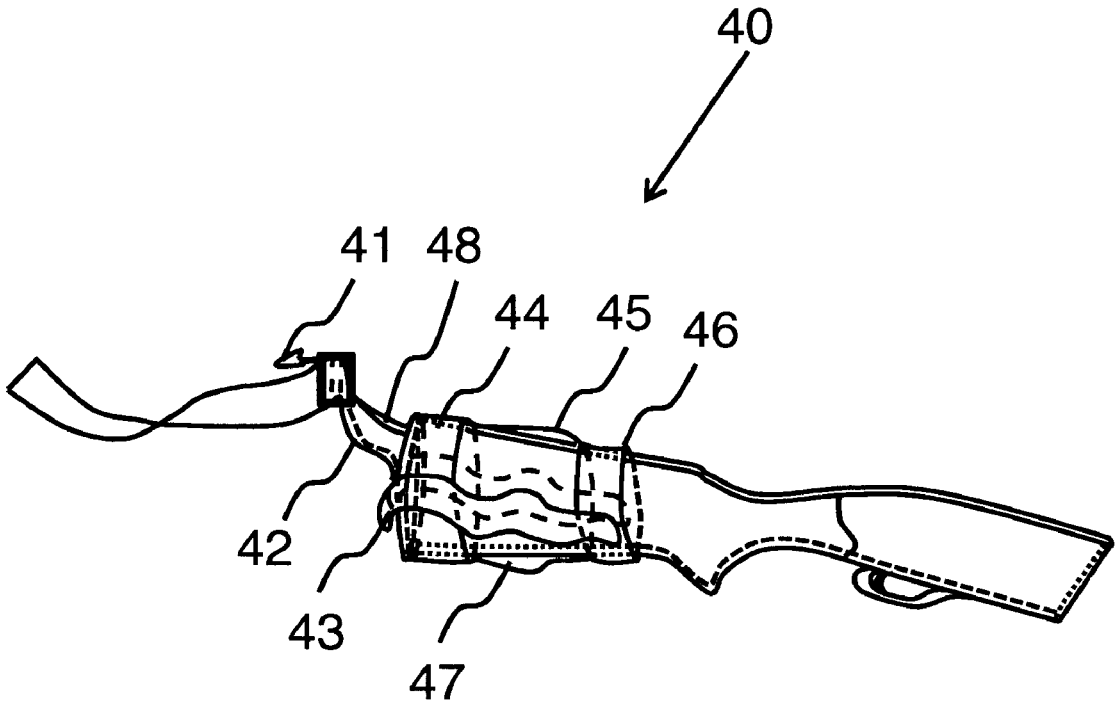
FIG. 3 is a schematic view of the gun butt harness attached to with the butt of a gun.

FIG. 3 shows a schematic view of the gun butt harness with a gun butt housed therein, shown generally at 40. The gun harness covers the stock portion of the gun. The stock of the gun is inserted into the gun harness through the opening as shown. The back of the gunstock rests against nylon webbing at 43. The bottom of the gunstock rests against nylon webbing at 47. The top and sides of the gunstock rests against nylon webbing at 44, 45, and 46, respectively. A piece of nylon strap 42 connects the gunstock to a male snap clip 41. The male snap clip 41 is operable for connection with the female snap clip 31 on the shoulder harness. The gun is now fully supported.

Figure 4:
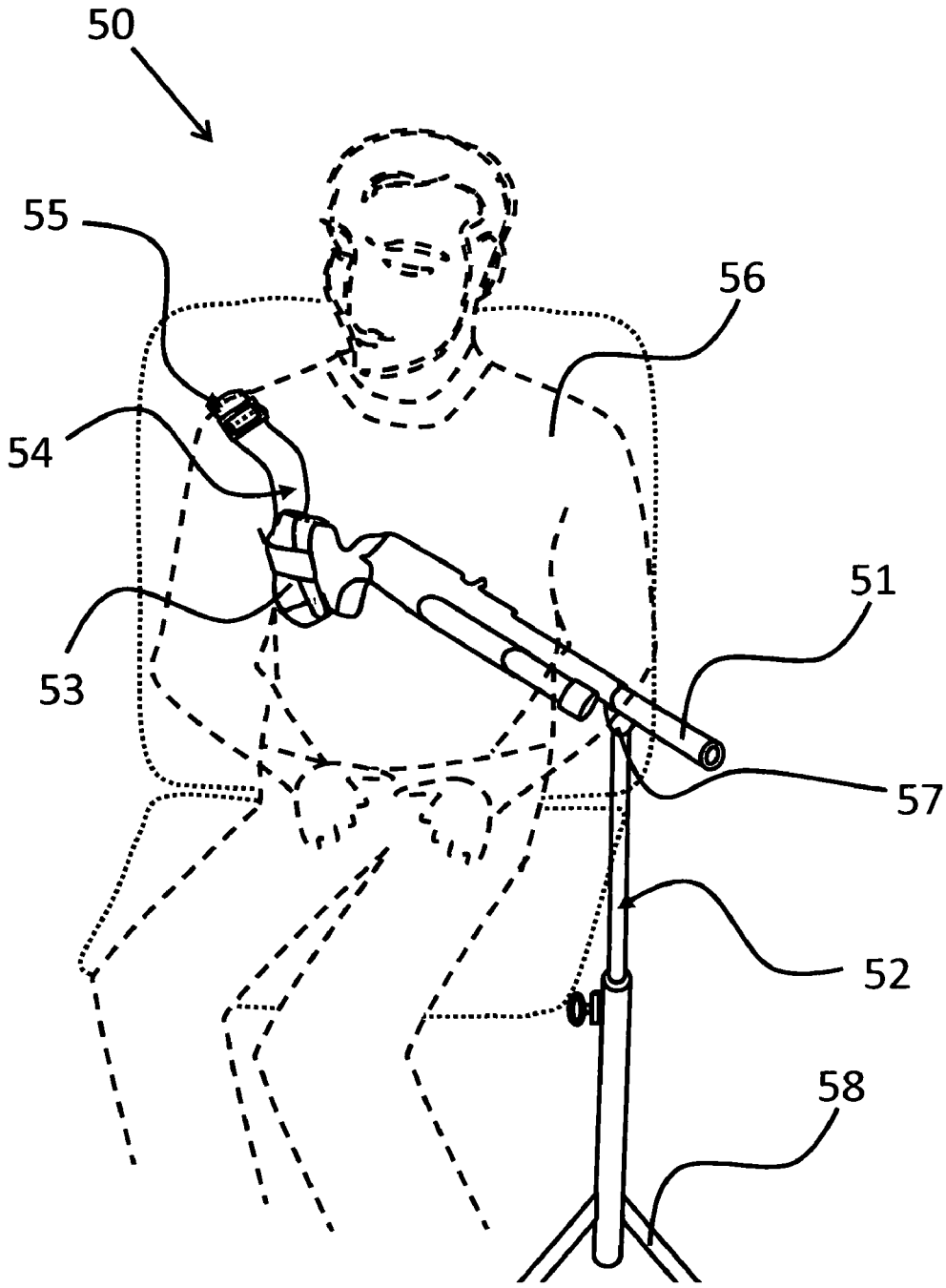
FIG. 4 is a front view depicting the first embodiment of the invention being worn by a hunter, wherein the front end of the gun is supported by the telescoping adjustable barrel stand and the butt end of the gun is housed within the gun butt harness and is supported by attachment of the gun butt harness to the shoulder harness worn by the user.

FIG. 4 is a front view depicting photograph depicting a first embodiment of the hands free gun support being worn by a hunter, shown generally at 50. The front end of the gun 51 is supported by the telescoping adjustable barrel stand 52. The butt end of the gun 53 is housed within the gun butt harness 54, which in turn is attached to, and supported by, the shoulder harness 55 worn by a hunter 56 (or user). Barrel stand 52 has a cradle 57 and three legs 58 which rest on the ground. The gun is supported by this structure while the butt end of the gun 51 is housed within the gun butt harness 54, which is firmly attached to the shoulder harness 55. The gun is precisely aimed at a target location and the hands of the user/hunter 56 are free.

Figure 5A:
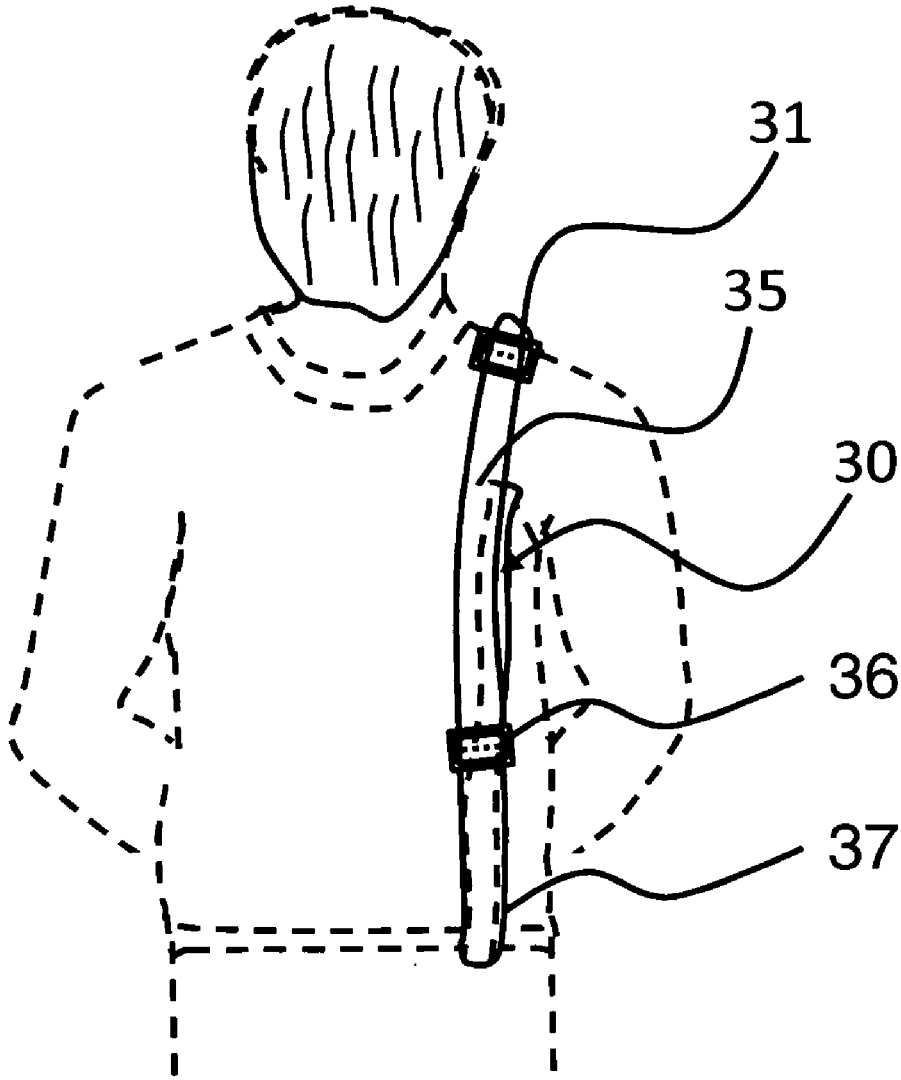
FIG. 5*a* shows the attachment of the shoulder harness to the backside belt of the user.
Figure 5B:
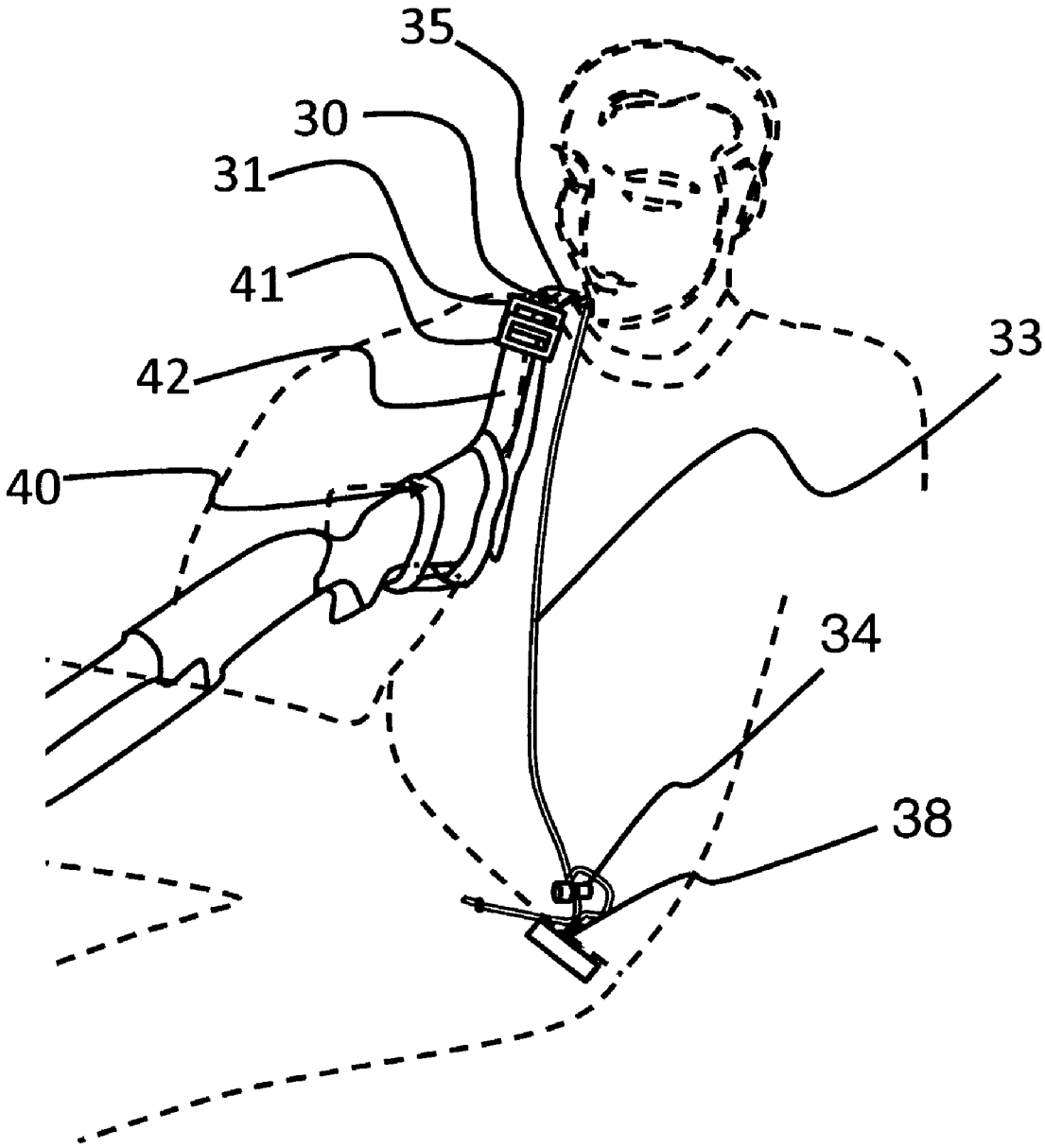
FIG. 5*b* shows the attachment of the shoulder harness to the front side belt of the user secured by way of the bungee cord.

FIG. 5*a* shows the attachment of the first end of a shoulder harness nylon-webbing strip to the backside belt of the user. Particularly, FIG. 5*a* shows the nylon-webbing strap 35 of the shoulder harness 30 (refer to FIG. 2) attached to the backside belt of the user by way of clip 37. Nylon-webbing strap 35 of the shoulder harness is adjusted with the standard adjustable clip 36 so that the female snap clip 31 (a portion of which is shown) is positioned near the top of the chest of the hunter. FIG. 5*b* shows the bungee cord attachment to the front side belt of the user. Particularly, FIG. 5*b* shows the nylon-webbing strap 35 of the shoulder harness 30 attached to the front side belt of the user by way of bungee cord 33. Female snap clip 31, located on nylon-webbing strap 35 of shoulder harness 30, is clipped to the gun butt harness 40 via male snap clip 41 located on nylon strap 42.

Figure 6:
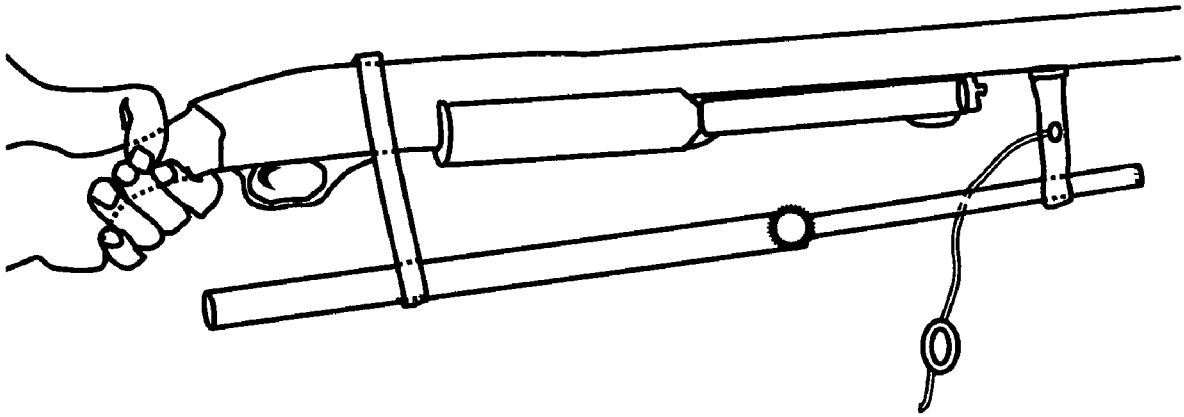
FIG. 6 shows a schematic view of the second embodiment of the invention wherein the telescoping barrel stand is collapsed and folded parallel to the gun barrel and anchored by the belt to the butt of the gun, and the smooth surface of barrel stand serves to rest the front side of the gun on a window sill.

FIG. 6 shows a schematic view of the second embodiment of the hands free gun support.

The hands free gun support apparatus for hunters comprises the following features in combination:

1) a telescoping barrel stand including a cradle on the top tubular portion removably inserted into a bottom tubular portion adjusted to a desired height and horizontal orientation by a setscrew;
   a. the top tubular portion further having a securable hinge that attaches to a gun cradle;
   b. the hinge being secured by a lynch pin in selected orientations or secured by a friction device;
   c. the bottom tubular portion having a plurality of foldable legs for supporting the barrel stand on the ground;
   d. the distal end of the bottom tubular portion further having a VELCRO® strap for removable attachment to the butt of the gun when the barrel stand is folded and secured at the hinge to bring the barrel stand parallel to the gun barrel;
   e. the folded barrel stand being adapted to enable the gun to rest on objects such as rocks, window sills and the like;
   f. the VELCRO locking together the gun and the hands free gun support while in transport;
2) a shoulder harness being worn diagonally across the hunter's chest and attached to the hunter's waist at each end of the shoulder harness;
3) a gun butt harness inserted over the gun stock and removably connected to the shoulder harness, providing support for the butt of the gun in its aimed firing position;

whereby the gun support fully supports the gun and enables the hunter's hands to be completely free.

Having thus described the invention in rather full detail, it will be understood that such detail need not be strictly adhered to, but that additional changes and modifications may suggest themselves to one skilled in the art, all falling within the scope of the invention as defined by the subjoined claims

What is claimed is:

1. A hands free gun support appointed for supporting a gun in an aimed firing position, comprising:

a. a telescoping barrel stand with a cradle for receiving a gun barrel providing front support to said gun in said aimed firing position;

b. said barrel stand having a lockable height adjustment and lockable horizontal and vertical plane orientation adjustments;

c. a gun butt harness removably attached to a shoulder harness worn across a chest of a hunter, said gun butt harness being appointed to receive a gun butt;

d. said shoulder harness having a nylon-webbing strap portion and a bungee cord portion each being provided with a clip for attachment to a back side and a front side of a belt of said hunter, respectively;

e. said gun butt harness, in combination with said shoulder harness, providing gun butt support to said gun in said aimed firing position;

whereby said gun is completely supported in said aimed firing position free of any hand support, substantially eliminating need for said hunter to hold said gun in a firing position, or to move said gun into a firing position when a game target is detected.

2. A hands free gun support as recited by claim 1, wherein said telescoping barrel stand has a top tube and a bottom tube sliding within each other and locked by a set screw in said bottom tube, providing said height adjustment of said barrel stand and providing said horizontal plane orientation adjustment.

3. A hands free gun support as recited by claim 2, wherein said top tube of said telescoping barrel stand has said cradle attached thereto.

4. A hands free gun support as recited by claim 2, wherein said bottom tube of said telescoping barrel stand has a plurality of foldable legs for supporting said barrel stand on level or rough ground.

5. A hands free gun support as recited by claim 2, wherein said bottom tube of said telescoping barrel stand has a strap with a hook and loop fastener.

6. A hands free gun support as recited by claim 3, wherein said top tube of said barrel stand has a lockable hinge for adjusting the vertical plane orientation of said cradle.

7. A hands free gun support as recited by claim 3, wherein said barrel stand is folded at said hinge for transportation of said gun with an attached barrel stand by a hook and loop fastener comprising a strap connected to said bottom tube of said barrel stand.

8. A hands free gun support as recited by claim 1, wherein said shoulder harness is adjusted by an adjustable clip on said nylon-webbing strap portion and a push-button clip operable with said bungee cord portion to vary its length and adjust said gun butt to said aimed firing position.

9. A hands free gun support as recited by claim 1, wherein said removable attachment of said gun butt harness to said shoulder harness is accomplished by a clasp buckle fastener.

10. A hands free gun support as recited by claim 1, wherein f. said telescoping barrel stand is rested on ground with foldable legs;

g. height, horizontal and vertical orientations are adjusted and locked by a setscrew;

h. said gun barrel is inserted in a cradle of said barrel stand, providing front gun support;

i. said gun butt is supported by a gun butt harness attached to a shoulder harness worn by said hunter, enabling the said gun to be aimed hands-free in a firing position.

11. The hands-free gun support as recited by claim 1, wherein j. said telescoping barrel stand is collapsed and folded parallel to the gun barrel and strapped to the gun butt by a hook and loop fastener strip; k. the smooth surface of said barrel stand is rested on a stationary object to support the front of said gun; and the gun butt is supported by a gun butt harness attached to a shoulder harness worn by the user enabling the gun to be aimed hands-free in a firing position.

* * * * *